US008555688B2

(12) United States Patent
Blecher

(10) Patent No.: US 8,555,688 B2
(45) Date of Patent: Oct. 15, 2013

(54) METHOD AND DEVICE FOR CHANGING ROLLS

(75) Inventor: Gerhard Blecher, Erndtebrück (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/428,902

(22) Filed: Mar. 23, 2012

(65) Prior Publication Data

US 2012/0180284 A1 Jul. 19, 2012

Related U.S. Application Data

(62) Division of application No. 12/087,194, filed as application No. PCT/EP2007/000107 on Jan. 9, 2007.

(30) Foreign Application Priority Data

Jan. 9, 2006 (DE) ..... 10 2006 001 316
Jul. 5, 2006 (DE) ..... 10 2006 030 934

(51) Int. Cl.
*B21B 31/08* (2006.01)
*B21B 31/00* (2006.01)

(52) U.S. Cl.
USPC ..... 72/239; 72/237; 72/238

(58) Field of Classification Search
USPC ..... 72/237–239, 241.2, 372; 483/16, 49, 483/51–53
See application file for complete search history.

(56) References Cited

U.S. PATENT DOCUMENTS 3,611,779 A * 10/1971 Simmonds ..... 72/239
3,638,468 A * 2/1972 Fukui et al. ..... 72/238
3,698,226 A * 10/1972 Eibe ..... 72/239
3,975,938 A * 8/1976 Schmidt et al. ..... 72/239
4,435,970 A 3/1984 Sekiya
6,053,020 A 4/2000 Tiepelmann et al.
7,165,432 B2 1/2007 Berendes et al.
7,698,923 B2 4/2010 Rackel
2005/0000263 A1 1/2005 Wittkopf
2006/0150702 A1 7/2006 Rackel et al.

FOREIGN PATENT DOCUMENTS

| | | |
|---|---|---|
| DE | 3123933 | 2/1982 |
| DE | 4321663 | 1/1995 |
| EP | 0911089 | 4/1999 |
| JP | 60196211 | 10/1985 |
| WO | 03015949 | 2/2003 |
| WO | 03099479 | 12/2003 |
| WO | 2004039512 | 5/2004 |
| WO | 2005089972 | 9/2005 |

* cited by examiner

*Primary Examiner* — Dana Ross
*Assistant Examiner* — Pradeep C Battula
(74) *Attorney, Agent, or Firm* — Lucas & Mercanti, LLP; Klaus P. Stoffel

(57) ABSTRACT

The invention relates to a method for changing rolls, in particular, working rolls and/or intermediate rolls in a roll stand, such as a roughing down stand or finishing stand for rolling thick sheet iron. Said rolls comprise back up roller sets and working roller sets. One individual locomotive mechanism is used for changing the working rolls and/or for changing the back up rolls and/or for inserting or withdrawing a roll changing seat by supporting the rolls on each other and subsequently withdrawing in the axial direction of the rolls on the operational side of the roll stand, from a roll hall in a roll workshop and back and for installing novel roll sets. The invention also relates to a device for carrying out said method.

4 Claims, 6 Drawing Sheets

2

1
2
3
4
5
6
7
8
9
10
11
16
17
18
19
20

1
2
3
4
7
8
9
10

1
2
3
4
5
6
9
10
20
23
25

1
2
3
4
7
8
9
10
13
14
20
26
31

METHOD AND DEVICE FOR CHANGING ROLLS

CROSS-REFERENCE TO RELATED APPLICATIONS

The present application is a Divisional Application of U.S. patent application Ser. No. 12/087,194, filed Jun. 28, 2008, which is a 371 of International application PCT/EP07/000107, filed Jan. 9, 2007, which claims priority of DE 10 2006 001 316.6, filed Jan. 9, 2006, and DE 10 2006 030 934.0, filed Jul. 5, 2006, the priority of these applications is hereby claimed and these applications are incorporated herein by reference.

BACKGROUND OF THE INVENTION

The invention concerns a roll-changing pit, which connects a mill hall with a roll workshop, such that a rolling stand with work rolls and back-up rolls is located in the mill hall; and such that a locomotive can move in the roll-changing pit in the axial direction of the work rolls and back-up rolls to transport used back-up rolls or work rolls out of the rolling stand and into the roll workshop or to transport new back-up rolls or work rolls from the roll workshop to the rolling stand.

The invention also concerns a method for changing a set of work rolls in a rolling stand, such as a roughing stand or a finishing stand for rolling plate, which comprises the following steps: supporting the used work rolls of the set of work rolls on each other and then moving the used set of work rolls in the axial direction of the work rolls on the operating side of the rolling stands from a mill hall to a roll workshop by means of a locomotive, which is moved in a roll-changing pit, which connects the mill hall with the roll workshop; and a method for changing a set of back-up rolls in a rolling stand, such as a roughing stand or a finishing stand for rolling plate, which comprises the following steps: insertion of a roll-changing frame between the used lower back-up roll and the used upper back-up roll by means of a locomotive and a connecting rod and then transporting the used set of back-up rolls in the axial direction of the back-up rolls on the operating side of the rolling stands from a mill hall to a roll workshop by means of the locomotive, which is moved in a roll-changing pit, which connects the mill hall with the roll workshop.

A roll-changing pit of this type and methods of this type are disclosed by JP 60-196211.

WO 03/099 479 A1 describes a device for changing pairs of work rolls and/or pairs of back-up rolls in rolling stands, in which the back-up rolls and the work rolls are guided in the housing frame in respective chocks that can be lifted or lowered, and the pair of work rolls can be moved out by a linear actuator while being supported on the chocks. The pair of back-up rolls can be moved in or out by means of a lower back-up roll supported on a track and wheels and a roll-changing frame, which supports the upper back-up roll and is supported on the lower back-up roll. In this regard, the pair of work rolls can be coupled on the drive side of the rolling stand with a hydraulic piston-cylinder actuator that is dimensioned in its stroke length for the removal or installation distance and can be uncoupled when it has been withdrawn the required distance. Furthermore, a roll-changing frame, which has been moved in at a height level between the back-up rolls, can be coupled to the same piston-cylinder actuator, and, when the upper back-up roll and the roll-changing frame are supported on the lower back-up roll, the pair of back-up rolls can be moved out or moved back in. The cited document also describes a corresponding method.

WO 2004/039 512 A1 discloses a tractor, with which the sets of rolls are pulled into a roll workshop (RW) and moved back again. The tractor is moved by gear wheels of the tractor that engage racks.

DE 43 21 663 A1 describes a rolling mill with support plates, which are arranged on the operating side of the rolling stands, are supported on carriages, can be displaced transversely to the roll axes, and are equipped with at least two pairs of rails, which are arranged side by side for receiving sets of work rolls supported on rollers, and with changing pits arranged in front of each rolling stand, with the bottom of each changing pit being equipped with runout rails covered between the stands and the support plates with cover plates that extend the length of the pit, which can be fixed in their initial position and can be swiveled out of this initial position to change the back-up rolls, and each cover plate is provided with a . . . for moving out sets of work rolls and transferring them to one of the pairs of tracks of the respective support plates assigned to it.

WO 03/015 949 A1 describes an apparatus for changing work rolls and back-up rolls of a strip rolling mill, in which a roll-changing carriage, which can be displaced transversely to the rolling stand and holds the old sets of rolls that have been removed, makes it possible to replace the old sets of rolls with new sets of rolls. The apparatus consists of a stationary changing cylinder mounted at the floor level of the mill, whose piston rod can move in and out transversely to the rolling stand, and of an extraction carriage connected to the forward end of said piston rod and movable on said roll-changing carriage, said extraction carriage being connectable with said roll-changing carriage such that said extraction carriage and said roll-changing carriage are movable together by said changing cylinder transversely to the longitudinal path of said strip mill. In addition, a side shift cylinder that is independent of the roll-changing carriage can move a side shift table, which is installed in said roll-changing carriage, transversely to the direction of movement of the roll-changing carriage, in order to move the sets of rolls to be changed in or out of a changing position which is aligned with the center of the rolling stand.

WO 2005/089 972 A1 describes a method for changing sets of rolls in rolling stands of a mill train with several rolling stands, each of which has back-up rolls and work rolls, by supporting them on each other and then moving them out in the axial direction of a set of work rolls or a set of back-up rolls on the operating side into a roll workshop and then moving new sets of rolls back and mounting them. During this operation, the sets of worn work rolls transported by a number of separate side shift carriages that corresponds to the number of rolling stands on the operating side are successively moved by a single locomotive on a single connecting track to the roll workshop, and from there the new sets of work rolls are driven back and at changing intervals are set down on the respective side shift carriages between the rolling stands, and after clearance of the operating side by the side shift carriages, after each dismounted worn set of work rolls, the worn back-up rolls are moved out, moved to the roll workshop by crane, serviced, transported back and remounted in the assigned rolling stands. The cited document also describes a device for carrying out this method.

DE 31 23 933 A1 discloses a device for changing the rolls of a rolling stand.

EP 0 911 089 A2 discloses a device and a method for making quick roll changes in a six-high rolling stand.

SUMMARY OF THE INVENTION

The objective of the invention is to propose a flexible method for changing the sets of rolls of the rolling stands with little expense with respect to the equipment and a roll-changing pit with a locomotive for carrying out the method of the invention.

In accordance with the invention, this objective is achieved by a roll-changing pit which has platforms at its two edges in its upper, wide region, such that the platforms are moved downward during the transport of the work rolls and upward during the transport of the back-up rolls, and such that the platforms have guide rails on their upper sides and are separated by a certain distance. By using only one locomotive, the second locomotive that has previously been used or needed, with all of its equipment, such as 4 electric motors, at 50 kW each
4 gear ratios
4 pinions
2 cable drums with cable
the complete electronics
the assembly, etc., is no longer needed.

The invention also concerns a method for changing a set of work rolls in a rolling stand, such as a roughing stand or a finishing stand for rolling plate, which comprises the following steps: supporting the used work rolls of the set of work rolls on each other and then moving the used set of work rolls in the axial direction of the work rolls on the operating side of the rolling stands from a mill hall to a roll workshop by means of a locomotive, which is moved in a roll-changing pit, which connects the mill hall with the roll workshop; wherein, to allow the used set of work rolls to be moved out, platforms, which have guide rails on their upper side, are moved downward on the upper edge of the roll-changing pit, and wherein the used set of work rolls is connected by a connecting rod with the locomotive and is pulled out of the rolling stand over the guide rails.

The invention further concerns a method for changing a set of back-up rolls in a rolling stand, such as a roughing stand or a finishing stand for rolling plate, which comprises the following steps: insertion of a roll-changing frame between the used lower back-up roll and the used upper back-up roll by means of a locomotive and a connecting rod and then transporting the used set of back-up rolls in the axial direction of the back-up rolls on the operating side of the rolling stands from a mill hall to a roll workshop by means of the locomotive, which is moved in a roll-changing pit, which connects the mill hall with the roll workshop, wherein the roll-changing frame is pushed into the rolling stand on platform that have been moved downward on the upper edge of the roll-changing pit; wherein the platforms are opened upward for transporting the used set of back-up rolls from the rolling stand to the roll workshop; and wherein the back-up rolls and the roll-changing frame, which is positioned between them, are pulled as a complete unit into the roll workshop by the locomotive. To this end, the sole locomotive is designed with a first coupling device for coupling back-up rolls and with a second coupling device for coupling work rolls and for coupling a roll-changing frame. As a result of the fact that the work rolls, the back-up rolls and the roll-changing frame can all be coupled to the same, i.e., the sole, locomotive, the second locomotive that is additionally needed in the prior art can be eliminated. All of the equipment and apparatus associated with a second locomotive, such as rails, etc., are also eliminated.

Further embodiments of the method are described in the associated dependent claims.

The total transport of the sets of rolls is carried out with only one hydraulic roll-changing locomotive. All of the sets of rolls are transported from the rolling stand to the roll workshop and back to the rolling stand.

Work Roll Change with Side Shifting

The apparatus for changing the work rolls is located on the operating side of the rolling mill.

The tasks of the work roll-changing apparatus consist in pulling used sets of work rolls out of the rolling stand and then, for example, transporting them to the roll workshop and in transporting the freshly ground sets of work rolls from the roll workshop back to the rolling stand.

The platforms arranged on both sides, on which the sets of work rolls are transported, are welded steel structures and serve as a track foundation during the roll change. The sets of work rolls are moved on these platforms to get from the rolling stand to the roll workshop or back to the rolling stand. Slide bars/slide rails are bolted onto these platforms and serve as slideways for the drawbar with the set of work rolls coupled to it. At the same time, the platforms cover the area of the roll-changing pit. They are hinged and are supported by a pivot. They are supported laterally on the foundation in order to receive a load.

Platforms of this type make it possible to carry out a work roll change with a hydraulic roll-changing locomotive, which is located in the lower region of the roll-changing pit.

The used sets of work rolls are now transported by the locomotive from the rolling stand to the roll workshop, or the new sets of work rolls are transported to the rolling stand.

Advantages for the Customer:

less maintenance,
the hall crane in the mill hall no longer needs to be designed for the weights of the back-up rolls.

A transport carriage for transporting the sets of rolls from the mill hall to the roll workshop or back to the mill hall is no longer needed.

A weight reduction of the platforms of about 50% is realized. Furthermore, 30-t racks with mounting material and feather keys are no longer needed. The complicated work on the platforms for mounting the racks is eliminated.

In the preparations for changing the back-up rolls, the hall crane is needed only for opening or closing the platforms. Due to their low height (width), the opened platforms do not interfere with the operation of the hall crane.

Removal of the platforms by the hall crane is not necessary. In addition, no space needs to be provided for setting down the platforms in the halls. This means time savings as well.

Side Shifting in the Mill Hall

The side shifting apparatus is located in the mill hall in the area of the roll-changing pit. The purpose of the side shifting is to shift the used set of work rolls that has been pulled out of the rolling stand sufficiently far from the pass line/center of the roll-changing pit that the new set of work rolls can be positioned in the pass line.

The roll-changing carriage no longer needs racks with mounting material and feather keys.

The complicated work involved in mounting the racks as well as the entire centering of the changing carriage are eliminated.

Back-Up Roll Change

The apparatus for changing the back-up rolls is located in the lower region of the roll-changing pit.

The tasks of the back-up roll-changing apparatus are transporting used sets of back-up rolls out of the rolling stand to the roll workshop and transporting the new sets of back-up rolls from the roll workshop back to the rolling stand.

The platforms arranged on both sides, on which the work rolls are transported, also serve as a track foundation for the roll-changing frame for the back-up rolls. The roll-changing frame for changing the back-up rolls is moved into the rolling stand on these platforms by means of the locomotive. The work roll-changing locomotive that is presently used for this purpose is no longer needed.

Savings in Connection with Changing the Back-Up Rolls

The entire work roll locomotive with all of its equipment is no longer needed.

Other Savings:

Smaller hall crane in the mill hall.

The operation that consists of the mill crane lifting the sets of rolls and then setting them down on the transport carriage to transport them to the roll workshop is eliminated.

The transport carriage with its drive mechanism for moving the rolls between the mill hall and the roll workshop is no longer needed.

Roll-Changing Locomotive for Changing the Work Rolls and Back-Up Rolls

The sets of work rolls and back-up rolls are transported with the roll-changing locomotive from the rolling stand to the roll workshop and/or the new sets of rolls are transported to the rolling stand. The roll-changing locomotive is located in the lower region of the roll-changing pit and consists essentially of the housing (carriage body):

4 hydraulic motors with transmission and pinion shaft 2 hydraulic cylinders 1 bayonet catch for the work roll change 1 bayonet catch for the back-up roll change Hydraulic Roll-Changing Locomotive The back-up roll change, the work roll change, and the movement of the back-up roll-changing frame into the rolling stand are accomplished by the hydraulic roll-changing locomotive.

The work roll-changing locomotive that is presently used for this purpose is no longer needed. Even if side shifting is being used in the mill hall or the roll workshop, this locomotive transports the sets of back-up rolls and work rolls to the roll workshop or back to the rolling stand.

Savings:

Smaller hall crane

The operation of the mill crane lifting the sets of rolls and then setting them down on the transport carriage to transport them to the roll workshop is eliminated.

The transport carriage with its drive mechanism for moving the rolls between the mill hall and the roll workshop is no longer needed.

The platforms arranged on both sides, on which the work rolls are transported, also serve as a track foundation for the roll-changing frame for the back-up rolls. The roll-changing frame for changing the back-up rolls is moved into the rolling stand on these platforms by means of the locomotive. The separate work roll-changing locomotive that has previously been used for this purpose is no longer needed.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

BRIEF DESCRIPTION OF THE DRAWING

In the drawing:

FIG. 6*a* is a cross-section of FIG. 6.

DETAILED DESCRIPTION OF THE INVENTION

Figures 1, 1A:
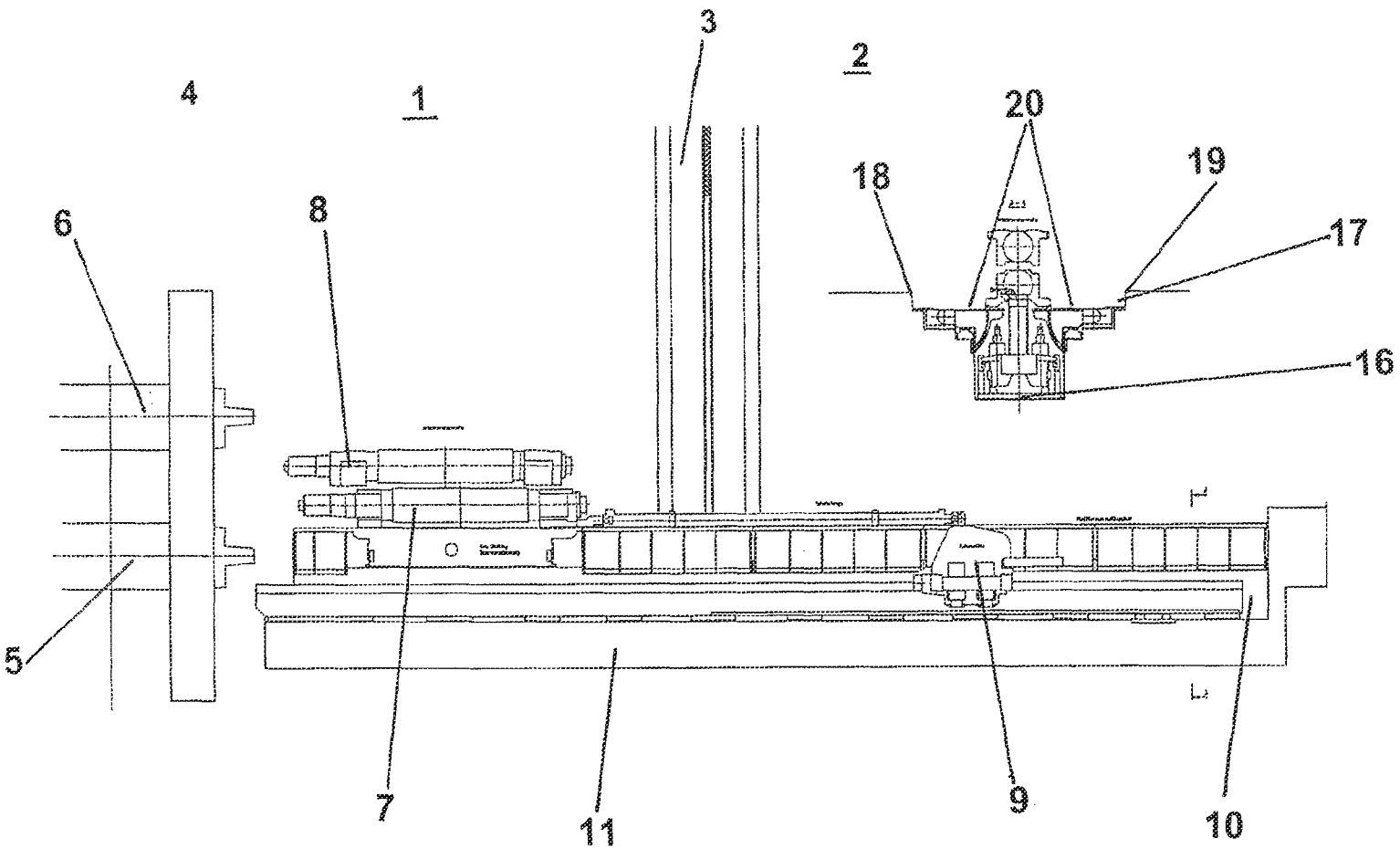
FIG. 1 shows a cross section of a mill hall with a rolling stand and a roll workshop that is separated from the mill hall by a wall as well as a roll-changing pit.
FIG. 1*a* is a cross-sectional view of a locomotive in the pit.

FIG. 1 shows a mill hall 1 on the left side in the rolling direction and a roll workshop 2 on the right side. The two areas are separated by a wall 3. A lower back-up roll 5, an upper back-up roll 6, a lower work roll 7, and an upper work roll 8 are mounted in a rolling stand 4. A locomotive 9 is used to transport rolls from the rolling stand 4 in the mill hall 2 to the roll workshop 2, for example, in order to regrind the rolls. The locomotive 9 is located in a pit 10, which connects the mill hall 1 and the roll workshop 2. All of the equipment, such as rails, etc., is installed on a foundation or several foundations 11. The locomotive 9 can thus be moved from a waiting position 12 at the right end of the pit 10 to the rolling stand 4. FIG. 1*a* is a cross-sectional view that shows how the locomotive 9 is installed in the pit 10. As the drawing shows, the pit 10 is divided into a lower, narrow region 16 and an upper, wide region 17. The lower, narrow region 16 is only slightly wider than the locomotive 9. The upper, wide region 17 has platforms 20 at its two edges 18, 19. The platforms 20 are moved downward when the work rolls 7, 8 are being removed or transported. The upper sides of the platforms 20 have guide rails 21, on which the work rolls 7, 8 can be moved. The platforms 20 are separated by a distance that allows a coupling device 14 mounted on the upper side 13 of the locomotive 9 to pass through. To transport the set of back-up rolls 5, 6, which have larger diameters, the platforms 20 are opened upward to allow the rolls to pass through. FIG. 1 also shows how the work rolls 7, 8 are positioned in the mill hall 1 alongside the rolling stand 4 while they are waiting to be transported further. The work rolls 7, 8 are connected by a connecting rod 15 to the locomotive 9, which pulls them out of the rolling stand 4.

Figures 2, 2A:
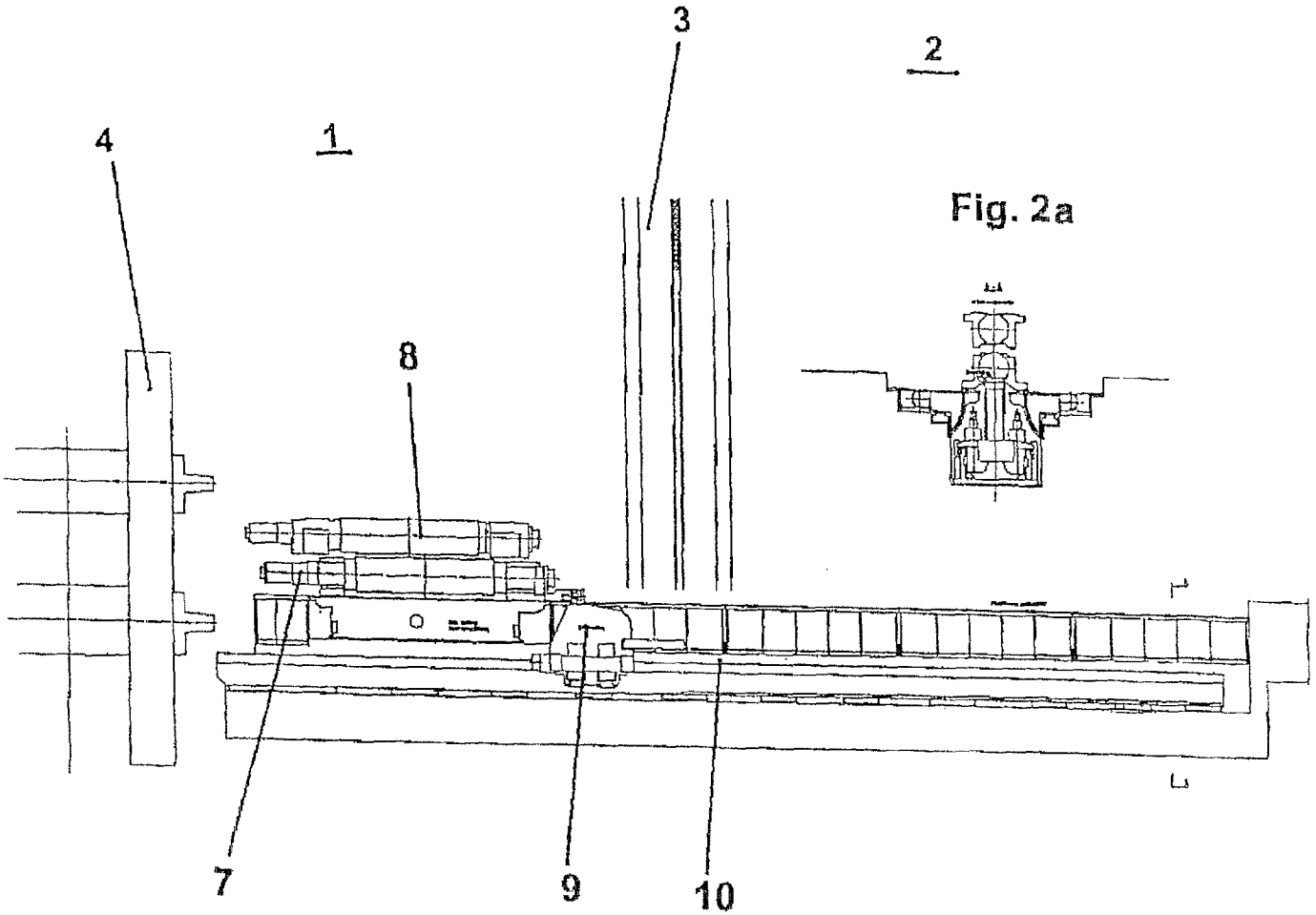
FIG. 2 is a cross-sectional drawing that shows the coupling of a locomotive to work rolls that have been moved out of the rolling stand.
FIG. 2*a* is a cross-section of FIG. 2.

As FIG. 2 shows, the connecting rod 15 is detached from the locomotive 9 and the lower work roll 7 and removed. The locomotive 9 can then be directly coupled with the lower work roll 7. The movement of the locomotive 9 in the pit 10, causes the set of work rolls 7, 8 to be moved into the roll workshop 2.

Figures 3, 3A:
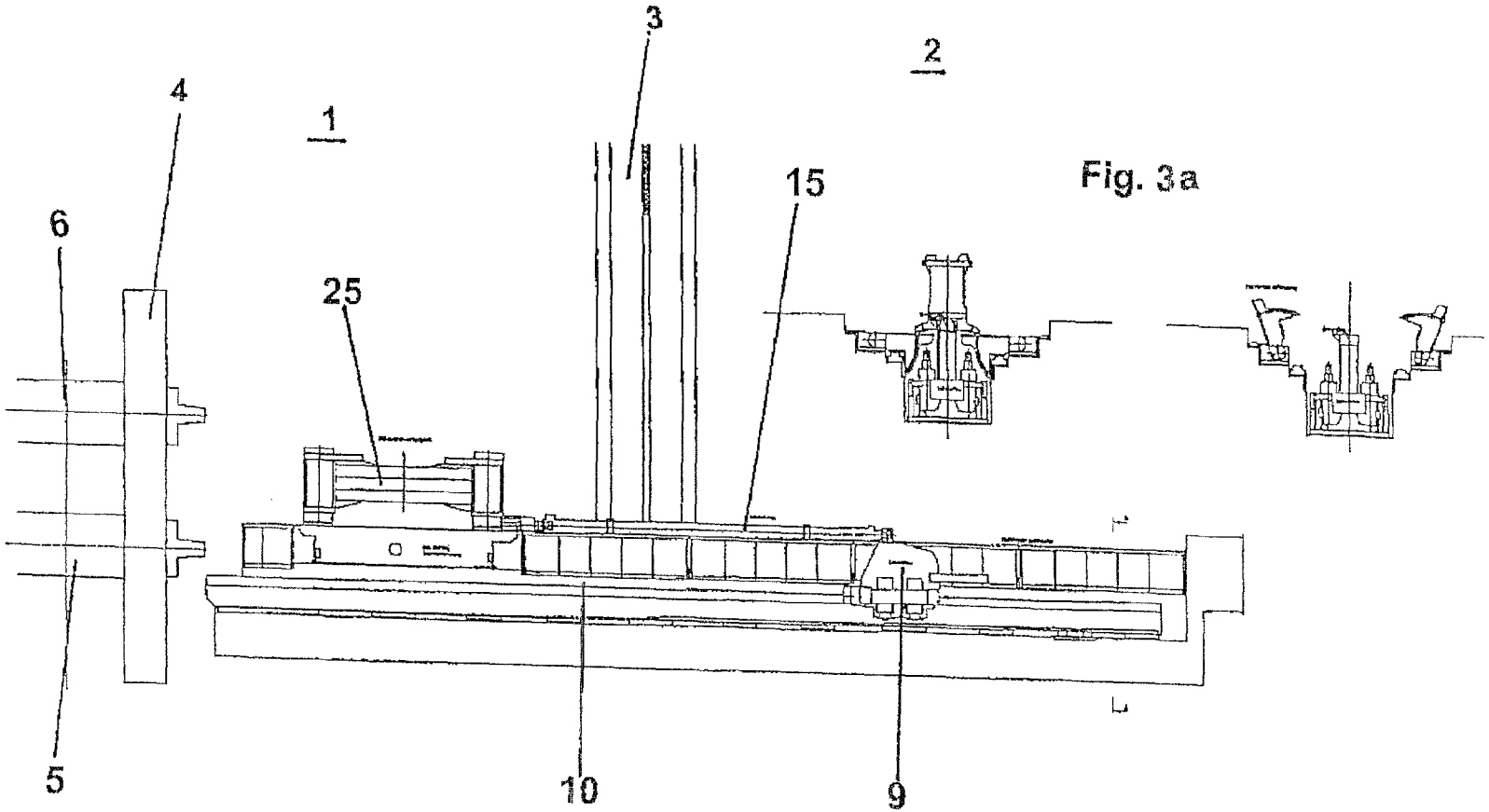
FIG. 3 shows a cross section of the mill hall with the roll-changing frame.
FIG. 3*a* shows cross-sections of FIG. 3.

FIG. 3 shows how the locomotive 9 and the connecting rod 15 push a roll-changing frame 25 into the rolling stand 4 between the lower back-up roll 5 and the upper back-up roll 6. After the roll-changing frame 25 has been positioned between the back-up rolls 5, 6, this complete unit is pulled out of the rolling stand 4 by the locomotive. An intermediate stop is made to remove the connecting rod 15 and couple the locomotive 9 directly to the lower back-up roll 5.

Figures 4, 4A:
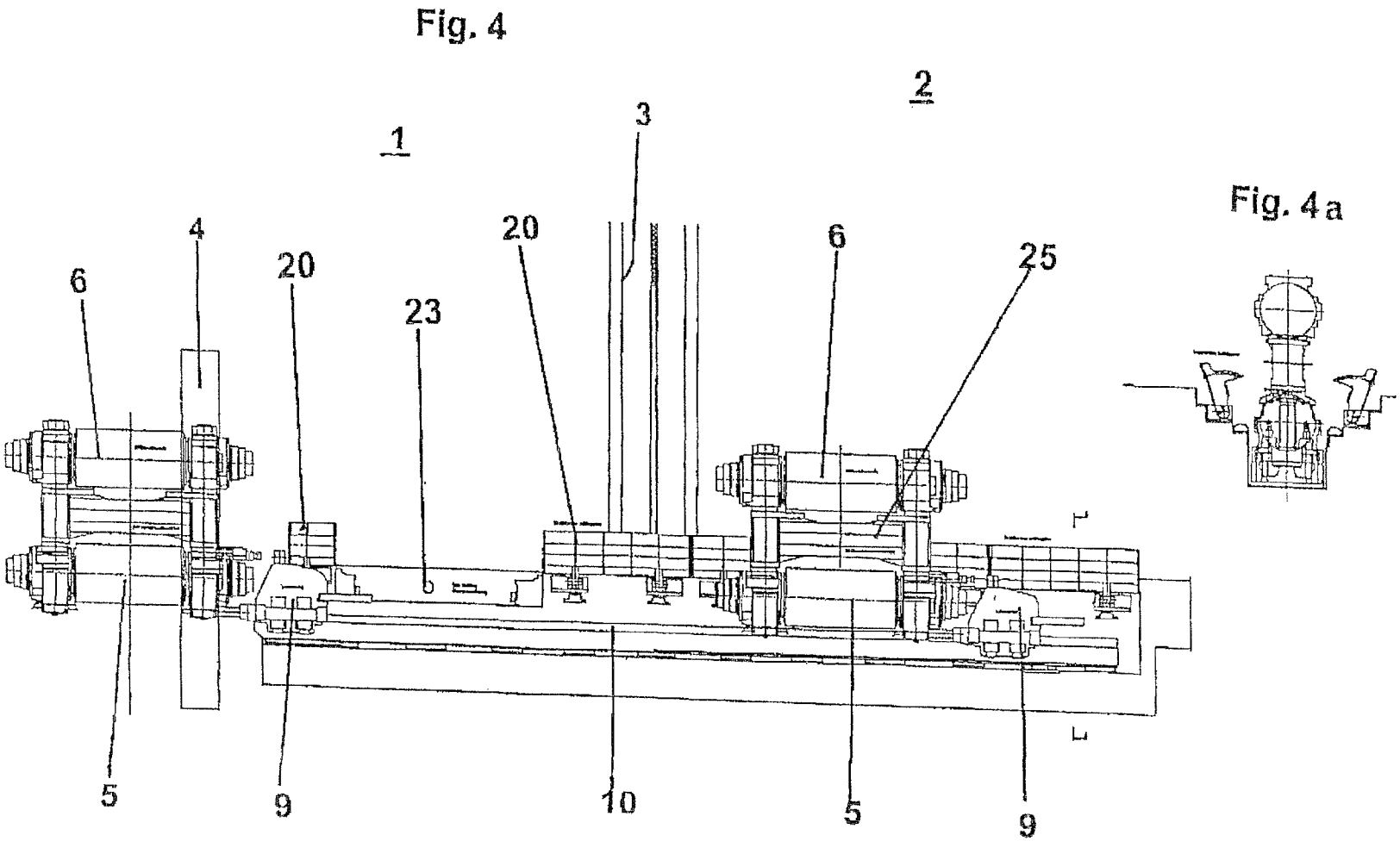
FIG. 4 shows back-up rolls and the roll-changing frame in the roll workshop.
FIG. 4*a* is a cross-section of FIG. 4.

As FIG. 4 shows, the locomotive 9 pulls the complete unit into the roll workshop 2. To accomplish this, the platforms 20 along the right and left edges of the pit must be opened upward to provide clearance for the locomotive 9 and the aforementioned unit, which consists of the back-up rolls 5, 6 and the roll-changing frame 25. In FIG. 4*a*, the opened platforms 20 are shown in a cross-sectional view towards the rolling stand 4 (not shown in FIG. 4*a*). On the left side of FIG. 4, i.e., in the mill hall 1, it is seen how the locomotive 9 is coupled with the back-up rolls 5, 6, which are still positioned in the rolling stand 4. On the right side of FIG. 4, i.e., in the roll workshop 2, it is seen how the same locomotive 9 is already positioned in the right parking position together with the unit comprising the back-up rolls 5, 6 and the roll-changing frame 25. There is only one locomotive, but in the drawing it is shown positioned in two places. In the mill hall 1, there is a gap between a left platform 20 and a right platform 20. This gap provides clearance for a shift platform 23. The space over the roll-changing pit 10 is bridged by this shift platform 23, and both the used work rolls and a new set of work rolls can be moved in the mill hall 1 in the direction of rolling or in the opposite direction. This operation is known as side shifting. A design of this type means that the handling of the work rolls during an exchange takes place in the mill hall.

Figures 5, 5A:
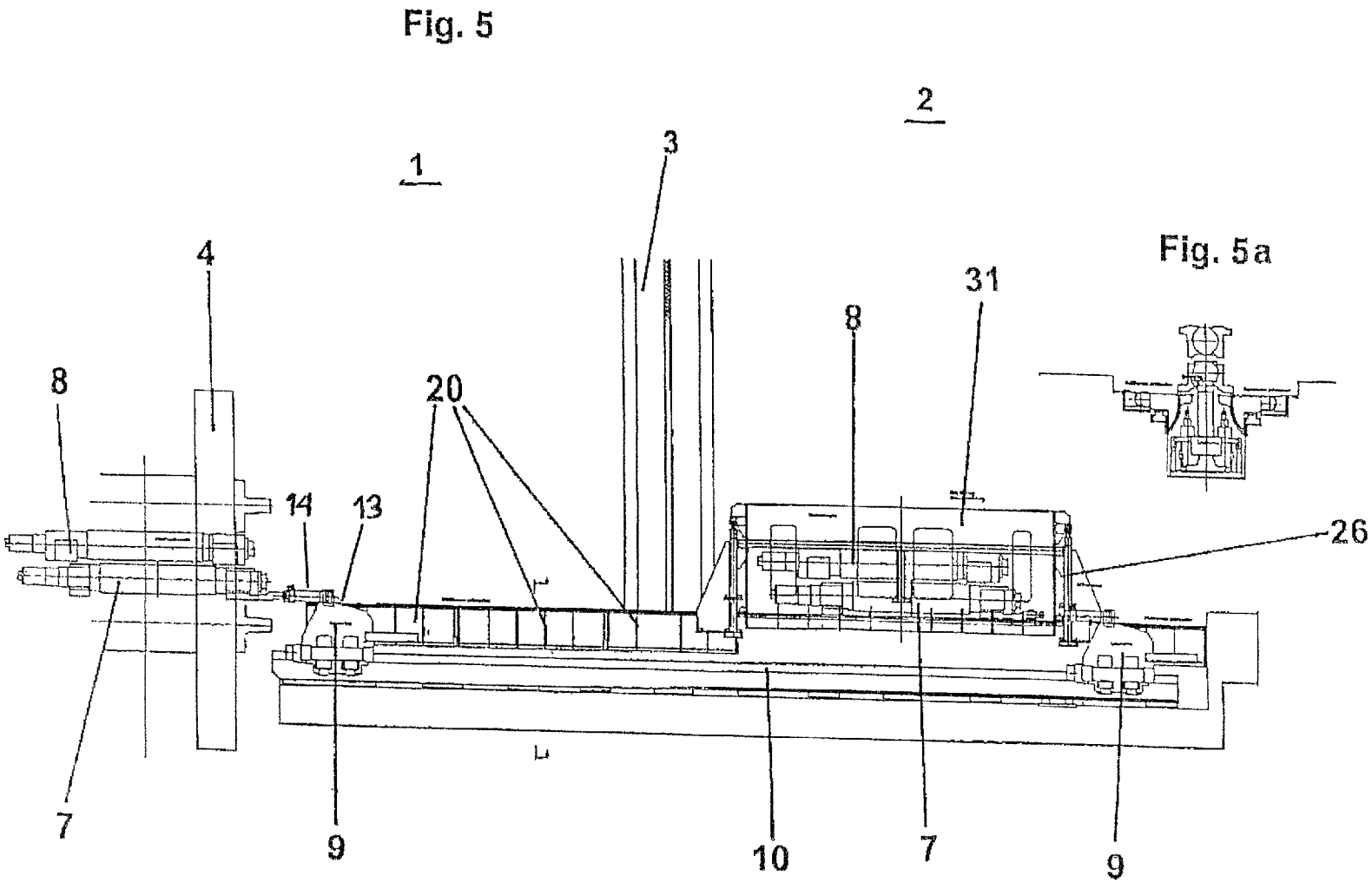
FIG. 5 shows the roll workshop with the support structure for holding the work rolls.
FIG. 5*a* is a cross section of FIG. 5.

FIG. 5 shows a design in which the work rolls 7, 8 are pulled directly into the roll workshop 2. The platforms 20 are moved downward to allow the rolls to move over them. A support structure 26 is located in the roll workshop 2. It facilitates the handling of the individual work rolls and back-up rolls during their treatment in the roll workshop 2. As is apparent, the work rolls 7, 8 are moved into the support structure 26 for this purpose. A roll-changing carriage 31 that can move on the support structure 26 in the direction of rolling or in the opposite direction is used for making the exchange of used and new work rolls. In this embodiment, side shifting is not provided in the mill hall 1. A design is shown, as in FIG. 4, in which the work rolls 7, 8 are coupled to the locomotive 9 while still positioned in the rolling stand 4 (left side). On the right side of the drawing, the same locomotive 9 is shown after it has already arrived in its parking/waiting position in the roll workshop 2. Here again, only a single locomotive 9 is involved.

Figure 6:
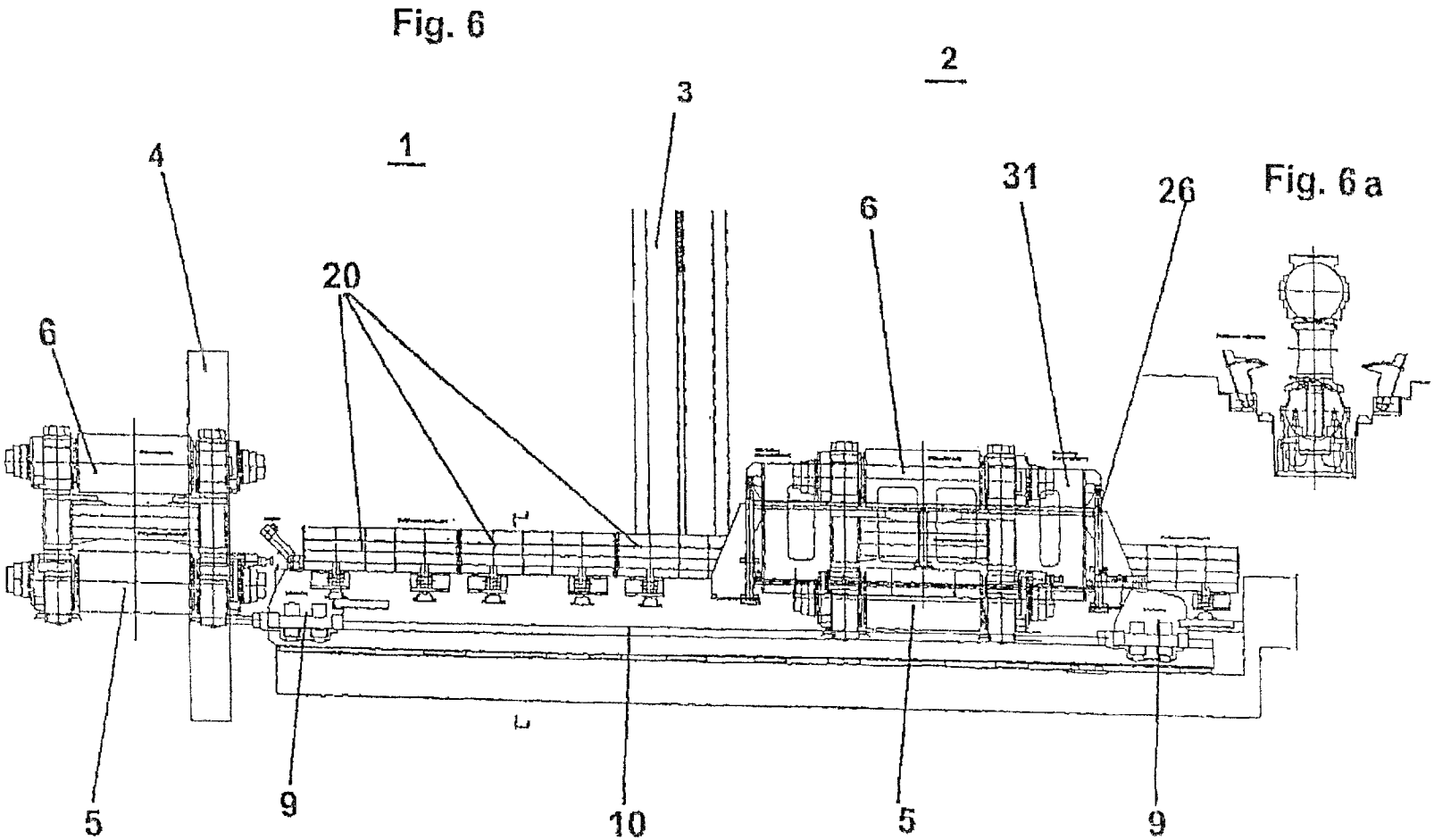
FIG. 6 shows the roll workshop as in FIG. 5 but with back-up rolls.

FIG. 6 shows a design in which the back-up rolls 5, 6 are pulled directly out of the rolling stand 4 with the locomotive 9. On the right side, the back-up rolls 5, 6 are already positioned in the roll workshop 2. Since there is 8 no shift platform 23 in the mill hall 1 (for exchanging the work rolls), the roll workshop 2 is equipped with the support structure 26 and the roll-changing carriage 31 that moves on it. In a free area above the roll-changing pit 10, no support structure 26 is constructed. This makes it possible for the locomotive 9 to transport the back-up rolls 5, 6 with the roll-changing frame 25 between a left part and a right part of the support structure 26 in the roll workshop 2 and to position them for further handling. For example, the back-up rolls 5, 6 require regrinding and to this end must be separated from each other in the roll workshop 2 and moved to certain treatment machines. In the mill hall 1, all the platforms 20 must be opened upward during the extraction of the back-up rolls, as shown in the cross-sectional view of FIG. 6*a*.

While specific embodiments of the invention have been shown and described in detail to illustrate the inventive principles, it will be understood that the invention may be embodied otherwise without departing from such principles.

I claim:

1. A method for changing a set of work rolls in a rolling stand, such as a roughing stand or a finishing stand for rolling plate, which comprises the following steps:

supporting the used work rolls of the set of work rolls on each other;

and then moving the used set of work rolls in the axial direction of the work rolls on the operating side of the rolling stand from a mill hall to a roll workshop by means of a locomotive, which is moved in a roll-changing pit, which connects the mill hall with the roll workshop; wherein, to allow the used set of work rolls to be moved out, platforms, which have guide rails on their upper side, are moved downward into a horizontal position on both upper edges of the roll-changing pit; and the used set of work rolls is connected by a connecting rod with the locomotive and is pulled out of the rolling stand over the guide rails.

2. The method in accordance with claim 1, wherein the connecting rod is coupled to a coupling device on the upper side of the locomotive.

3. The method in accordance with claim 2, wherein the platforms are separated in the horizontal position by a distance that allows the coupling device to pass between the platforms.

4. The method in accordance with claim 1, wherein a new set of work rolls is moved from the roll workshop into the rolling stand over the guide rails by means of the locomotive, where the new set of work rolls is mounted in the rolling stand.

* * * * *